US008191880B2

(12) United States Patent
Oh et al.

(10) Patent No.: US 8,191,880 B2
(45) Date of Patent: Jun. 5, 2012

(54) SHEET METAL GROUND CONDUCTOR CLAMP

(75) Inventors: Michael H.-S. Oh, Twinsburg, OH (US); Michael J. Gassman, Shaker Heights, OH (US); Thomas R. Bockstoce, Akron, OH (US); Steven J. Burkhart, Doylestown, OH (US)

(73) Assignee: ERICO Internaional Corporation, Solon, OH (US)

( * ) Notice: Subject to any disclaimer, the term of this patent is extended or adjusted under 35 U.S.C. 154(b) by 1031 days.

(21) Appl. No.: 12/135,329

(22) Filed: Jun. 9, 2008

(65) Prior Publication Data

US 2008/0303198 A1 Dec. 11, 2008

Related U.S. Application Data

(60) Provisional application No. 60/942,464, filed on Jun. 7, 2007.

(51) Int. Cl.
*H01R 4/36* (2006.01)

(52) U.S. Cl. ..... 269/287; 24/278; 439/795; 439/800; 439/810

(58) Field of Classification Search ..... 269/287; 24/3.12, 275, 278, 20 R, 37; 439/800, 795, 439/100

See application file for complete search history.

(56) References Cited

U.S. PATENT DOCUMENTS

| | | | | |
|---|---|---|---|---|
| 796,797 | A * | 8/1905 | Blackburn | 439/800 |
| 2,114,752 | A * | 4/1938 | Tallman | 439/795 |
| 5,494,462 | A | 2/1996 | Auclair | |
| 6,875,045 | B1 | 4/2005 | Hollick | |
| D536,229 | S | 2/2007 | Clark et al. | |
| 2005/0085111 | A1 | 4/2005 | Clark et al. | |

FOREIGN PATENT DOCUMENTS

| | | |
|---|---|---|
| DE | 1107755 | 5/1961 |
| DE | 1214761 | 4/1966 |
| DE | 202004013761 | 12/2004 |

OTHER PUBLICATIONS

International Search Report and Written Opinion from corresponding International Application No. PCT/US08/66018.
"Ground Rod Clamps", Lightning Protection Systems, Independent Protection Co., Inc., Goshen, Indiana, www.ipclp.com.
"Ground Rod Clamps", Duronze [copper alloy] clamps, Stocking Distributor: Storm Copper Components Co.
"Ground Rod Clamps", Harger, [online] [retrieved on Sep. 15, 2008], <http://www.harger.com/products/grdcmp/grdeleac/grc.cfm.

(Continued)

*Primary Examiner* — Lee D Wilson
*Assistant Examiner* — Jamal Daniel
(74) *Attorney, Agent, or Firm* — Renner, Otto, Boisselle & Sklar, LLP

(57) ABSTRACT

A ground conductor clamp has a sheet metal clamp body with overlapped portions. The clamp body may be stamped from sheet metal. The overlapped portions have aligned circular holes in them for receiving a threaded insert nut inserted into them. The insert nut is spin riveted to attach it to the overlapped portions of the clamp body. A flange of the insert nut has a flat face that engages the clamp body to prevent rotation of the insert nut. The overlapped portion includes an inner bent tab that strengthens the sheet metal clamp body. The clamp also includes a threaded fastener, such as a bolt, that is threaded into the insert nut to engage a conductive lead and a ground conductor, such as a ground rod or ground electrode.

16 Claims, 3 Drawing Sheets

OTHER PUBLICATIONS

"ERITECH Ground Rod Accessories—North & Latin America", ERICO, [online] [retrieved on Sep. 15, 2008], <http://www.erico.com/productPrint.asp?productid=1364.

International Preliminary Report on Patentability from corresponding International Application No. PCT/US08/66018.

* cited by examiner

SHEET METAL GROUND CONDUCTOR CLAMP

This applications claims priority under 35 USC 119 to U.S. Provisional Patent Application No. 60/942,464, filed Jun. 7, 2007, which is incorporated herein by reference in its entirety.

BACKGROUND OF THE INVENTION

1. Technical Field of the Invention

The invention relates to clamps, and specifically to ground conductor clamps for clamping two or more conductive items together.

2. Description of the Related Art

Clamps for making electrical connections to ground rods or electrodes have often been made of cast copper alloy materials. Such cast materials tend to be rigid, allowing only a point-to-point connection to be made between a ground rod and the clamp. Cast materials ordinarily do not conform to the ground rod or electrode, leading to a localized contact area between the clamp and the ground conductor, resulting in poor current flow and low pull-out load values. Cast materials also tend to be brittle.

From the foregoing it will be appreciated that improvements would be beneficial in the field of ground conductor clamps.

SUMMARY OF THE INVENTION

According to an aspect of the invention, a ground conductor clamp has a sheet metal clamp body with overlapped portions.

According to another aspect of the invention, a ground conductor clamp has a sheet metal clamp body, and a threaded insert nut in a hole in the clamp body. The threaded insert nut may have a flange that allows only one side of the insert to be inserted into the hole. The flange may have a flat face that engages the clamp body to prevent rotation of the threaded insert.

According to yet another aspect of the invention, a ground conductor clamp is made of sheet metal having a thickness of 1.9 mm (0.075 inches) or less.

According to still another aspect of the invention, a clamp includes: a non-rigid sheet metal clamp body with an overlapped section, defining an enclosed space surrounded by the clamp body, for receiving objects to be clamped. The clamp may include one or more of the following features: the sheet metal body includes stainless steel; the overlapped section includes a pair of ends with respective holes therein, wherein the holes are substantially aligned when the ends are overlapped; the clamp body has a V-shape bottom portion that is opposite the holes; the clamp body has a pair of substantially parallel sides between the bottom portion and the ends; one of the ends of the overlapped section includes a bent tab that presses against the side adjacent the other of the ends; the sheet metal body is stamped from a sheet metal strip; the sheet metal strip has top/bottom symmetry about a line in a longitudinal direction of the strip; the sheet metal strip has left/right symmetry about a line perpendicular to the longitudinal direction of the strip; a threaded nut is inserted in the holes; the threaded nut is riveted to the sheet metal body; the threaded nut is spin riveted to the sheet metal body; the nut has a flange on a lower part, wherein the flange limits insertion of the nut into the holes; the flange has a flat face that engages the bent tab to prevent rotation of the nut relative to the clamp body; the flange is circular except for the flat face; the nut and the sheet metal body are made from the same material; a threaded fastener is threaded through the nut to engage one or more objects in the enclosed space.

According to a further aspect of the invention, a clamp includes: a non-rigid sheet metal clamp body with an overlapped section, defining an enclosed space surrounded by the clamp body, for receiving objects to be clamped, wherein the overlapped section includes a pair of ends with respective holes therein, wherein the holes are substantially aligned when the ends are overlapped; and a threaded nut inserted in the holes.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the accompanying drawings, which are not necessarily to scale.

DETAILED DESCRIPTION

Figure 1:
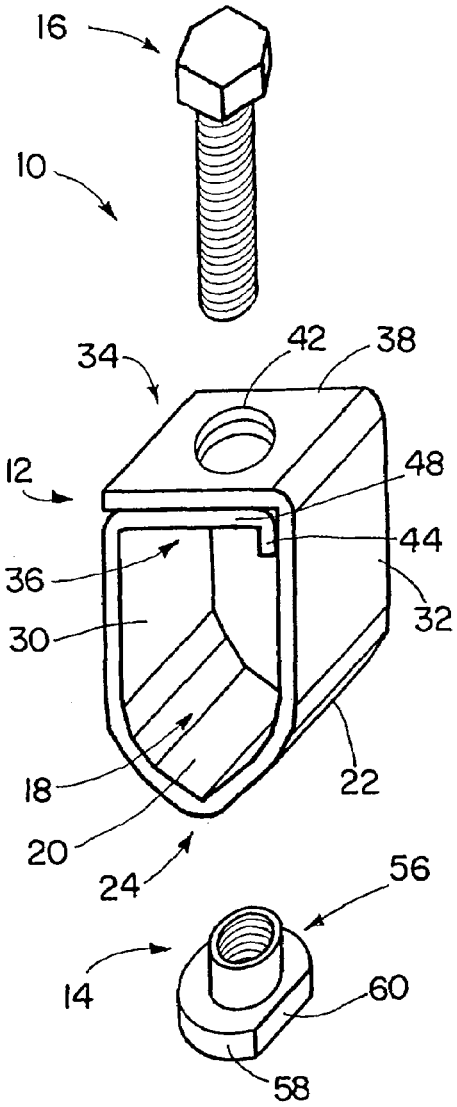
FIG. 1 is an exploded view of a clamp in accordance with an embodiment of the invention.
Figure 2:
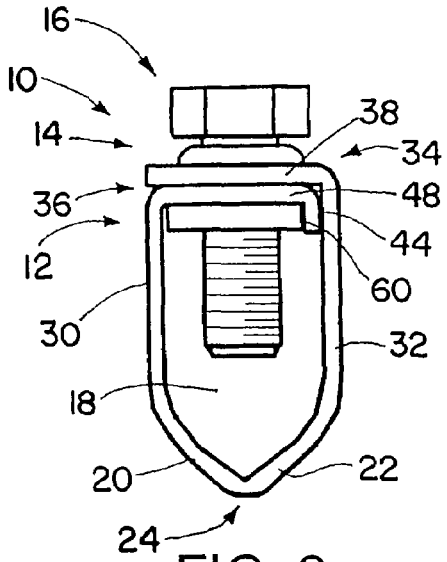
FIG. 2 is a side view of the clamp of FIG. 1.
Figure 3:
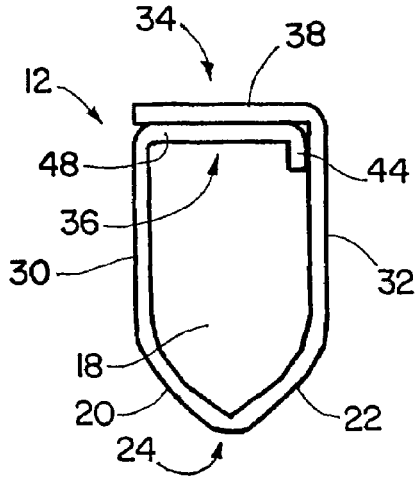
FIG. 3 is a side view of the clamp body of the clamp of FIG. 1.
Figure 4:
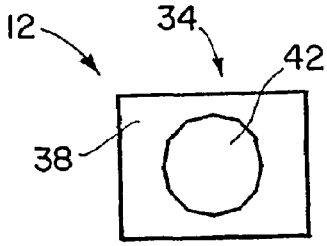
FIG. 4 is a top view of the clamp body of FIG. 3.

A ground conductor clamp has a sheet metal clamp body with overlapped portions. The clamp body may be stamped from sheet metal. The overlapped portions have aligned circular holes in them for receiving a threaded insert nut inserted into them. The insert nut is spin riveted to attach it to the overlapped portions of the clamp body. A flange of the insert nut has a flat face that engages the clamp body to prevent rotation of the insert nut. The overlapped portion includes an inner bent tab that strengthens the sheet metal clamp body. The clamp also includes a threaded fastener, such as a bolt, that is threaded into the insert nut to engage a conductive lead and a ground conductor, such as a ground rod or ground electrode.

Referring initially to FIGS. 1-4, a clamp 10 includes a clamp body 12, a threaded insert nut 14, and a bolt or other threaded fastener 16. The insert nut 14 is inserted into and attached to the clamp body 12. The threaded fastener 16 is threaded into the nut 14, to clamp one or more objects in an enclosed space 18 surrounded by the clamp body 12.

The clamp body 12 has a pair of bottom segments 20 and 22 that form a V shape, meeting at a bottom bend 24. The bend 24 may be at an acute angle.

Proceeding upward from the bottom segments 20 and 22, the clamp body 12 has a pair of substantially vertical sides 30 and 32. The sides 30 and 32 are substantially parallel to one another on opposite sides of the clamp body 12. It will be appreciated that alternatively the sides 30 and 32 may be angled toward or away from one another.

At the top of the clamp body 12 is an overlapped section 34, involving an overlapping of ends 36 and 38 proceeding from the sides 30 and 32, respectively. The ends 36 and 38 are bent substantially at right angles to the sides 30 and 32. The ends 36 and 38 have respective round holes 40 and 42 in them for receiving the insert nut 14. When the ends 36 and 38 are overlapped, the holes 40 and 42 are aligned with one another, and the inserted nut 14 is inserted into the holes 40 and 42. The insert nut 14 aids in holding the ends 36 and 38 in their overlapped relationship.

In the overlapped section 34 the end 38 is on top of the end 36. The end 38 is planar, with the hole 42 in its middle. The end 36, which is underneath the end 38, includes an end tab 44 that is bent downward at a right angle from an end body 48 of the end 36. The downward-bent end tab 44 makes contact with the side 32 when the end 38 overlaps the end 36. The contact between the end tab 44 and the side 32 aids in maintaining the shape of the clamp body 12 when the clamp body 12 is under load. In particular, the end tab 44 helps prevent the clamp body 12 from twisting as the torque on the threaded fastener 16 is increased. The end tab 44 also prevents elongation of the clamp body 12 as the threaded fastener 16 is torqued. Further, the end tab 44 provides additional material to one side of the hole 42, helping to maintain integrity of the clamp body 12 as the threaded fastener 16 is tightened.

Figure 5:
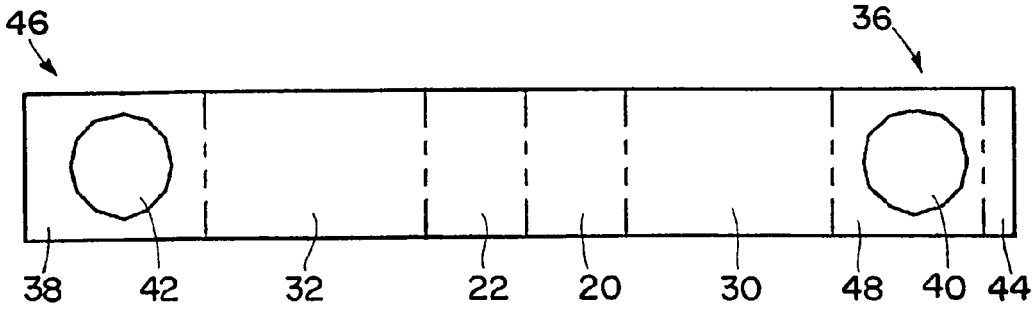
FIG. 5 is a plan view of a metal strip used to form the clamp body of FIG. 3.

Referring now in addition to FIG. 5, the clamp body 12 is a folded sheet metal part, stamped from a sheet metal strip 46. The strip 46 may have left/right symmetry (symmetry in a longitudinal direction running from one of the ends 36 and 38 to the other), and/or may have top/bottom symmetry (symmetry in a direction perpendicular to the direction of left/right symmetry). The sheet metal strip 46 may be made from stainless steel or any of a variety of other suitable materials, for example copper, copperclad (steel with a surface layer of copper), galvanized steel, plated steel, or aluminum. The strip 46 may be a non-rigid strip having thickness of 1.9 mm (0.075 inches) or less. More narrowly, the strip 46 may have a thickness of from 1.70 mm (0.067 inches) to 1.90 mm (0.075 inches). It will be appreciated that other suitable thicknesses may be used.

Figure 6:
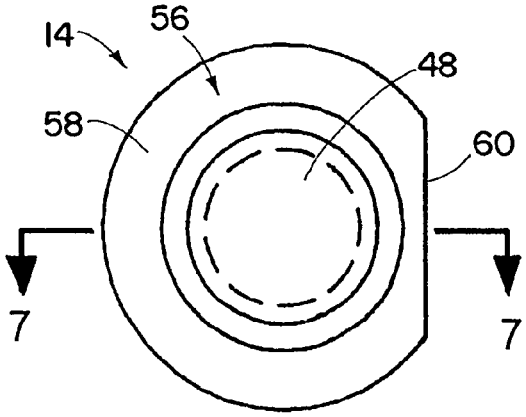
FIG. 6 is a plan view of the insert nut of clamp of FIG. 1.
Figure 7:
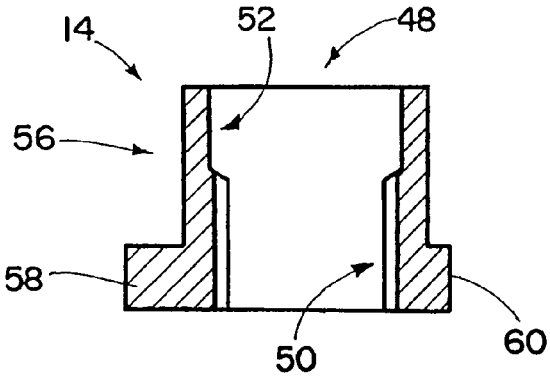
FIG. 7 is a sectional view along section 7-7 of FIG. 6.
Figure 9:
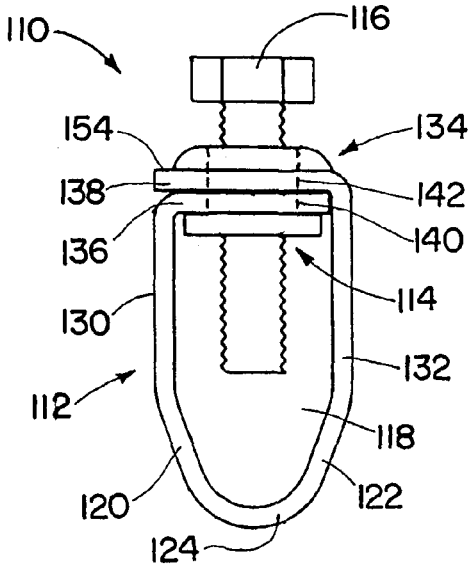
FIG. 9 is a side view of an alternate embodiment clamp in accordance with the present invention.
Figure 10:
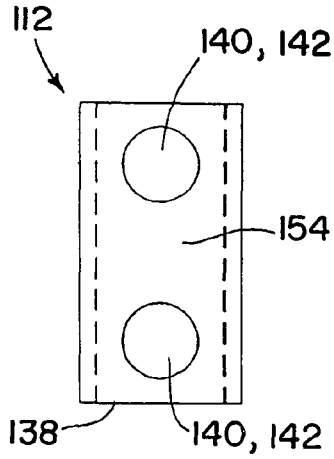
FIG. 10 is a top view of the clamp body of the clamp of FIG. 9.
Figure 11:
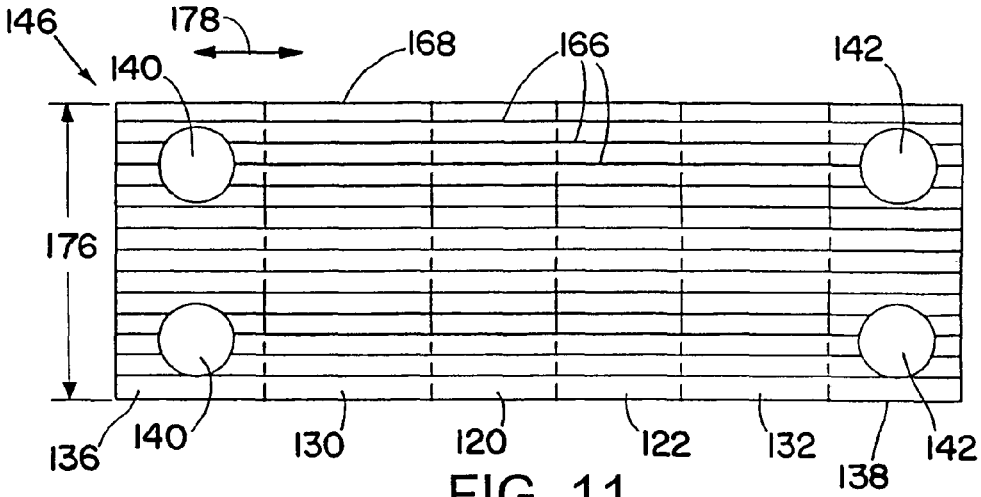
FIG. 11 is a plan view of a metal strip used to form the clamp body of FIG. 10.
Figure 12:
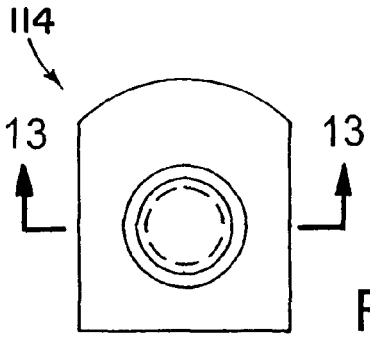
FIG. 12 is a plan view of the insert nut of clamp of FIG. 9.
Figure 13:
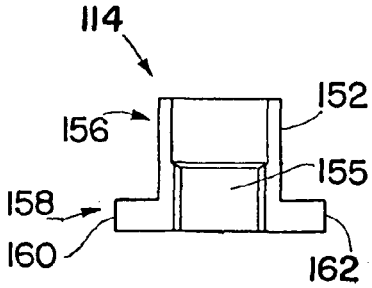
FIG. 13 is a sectional view along section 13-13 of FIG. 12.

With reference now to FIGS. 6 and 7 as well, the insert nut 14 has a central hole 48 that is threaded along a lower hole section 50. The hole 48 also includes an unthreaded upper hole section 52. The insert nut 14 has a cylindrical insert nut body 56. The nut body 56 has an outward-protruding flange 58 at its bottom, protruding outward from the nut body 56 around the entire circumference of the nut body 56. The upper part of the nut body 56 has a diameter that is only slightly smaller than that of the holes 40 and 42. This allows the upper part of the nut body 56 to be inserted into the holes 40 and 42. The flange 58, with its larger extent, is unable to be inserted into the holes 40 and 42.

The flange 58 is generally circular, but has a flat face 60 at one side. When the nut 14 is installed in the holes 40 and 42, the flat face 60 is against the end tab 44 of the clamp body 12. This prevents rotation of the insert nut 14. The end tab 44 is thus restrained on one major surface by the clamp body side 32, and on its opposite major surface by the flat insert nut face 60. The engagement of the flat face 60 with the end tab 44 improves structural stability of the clamp body 12.

The nut 14 may be engaged with the clamp body 12 by first inserting the upper part of the nut body 56 into the holes 40 and 42 of the overlapped section 34 of the clamp body 12. The flange 58 serves as a stop that limits the insertion of the nut 14. The upper part of the nut body 56 may then be riveted, such as by spin riveting, to secure the nut 14 to the clamp body 12. It will be appreciated that alternatively the nut body 14 may be attached to the clamp body 12 by a variety of other suitable processes.

The nut 14 may be made of stainless steel or another suitable material. The nut 14 may be made of the same material as the clamp body 12. The nut 14 may be made using suitable fabrication processes, such as machining or hard forming.

The threaded fastener 16 may be a bolt or other suitable fastener. The fastener 16 may be a standard-size off-the-shelf fastener. The fastener 16 may have a hex head or a square head, or another suitable head. The fastener 16 may be made of the same material as the clamp body 12 and/or the insert nut 14, or alternatively may be made of a different material.

The threaded fastener 16 may be selected from fasteners having a variety of lengths. Fasteners 16 with different lengths may be used to accommodate different sizes of objects in the enclosed space 18.

Figure 8:
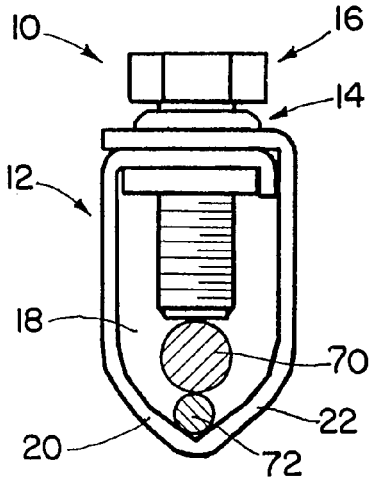
FIG. 8 is side view of the clamp of FIG. 1, clamping a connecting wire and a ground electrode.

Turning now to FIG. 8, the clamp 10 may be used to secure together a ground electrode 70 and a connecting wire 72. The ground electrode 70 and the connecting wire 72 are placed in the space 18 in the clamp body 12, with the connecting wire 72 in the bend 24, below the ground electrode 70. The threaded fastener 16 is then screwed into the insert nut 14. The threaded fastener 16 presses down on the electrode 70. This clamps the connecting wire 72 between the electrode 70 and the bottom segments 20 and 22 of the clamp body 12. Good electrical contact between the electrode 70 and the connecting wire 72 is thus produced. Tightening the fastener 16 against the electrode 70 advantageously causes the sheet metal of the clamp body 12 to conform to a degree to the electrode 70 and the connecting wire 72. This advantageously increases the conduction area between the clamp body 12 and the electrode 70 and the connecting wire 72. The clamp 10 is able to engage a variety of sizes and shapes of electrodes 70 and connecting wires 72.

The clamp 10 described herein has many advantages: lower cost than cast clamps, use of smaller bolts than are typically used in cast clamps of the same size, and a structurally strong clamp body 12 that is able to withstand stresses induced by tightening of the fastener 16. The clamp body 12 is made of non-rigid sheet metal, which allows the clamp body 12 to conform to the clamped objects as the fastener 16 is tightened.

FIGS. 9-13 show another embodiment, a clamp 110 with a clamp body 112. The clamp body 112 is similar in many ways to the clamp body 12 (FIG. 1). The clamp body 112 encloses an enclosed space 118 for coupling a wire or cable to a metal bar or rod. A pair of insert nuts 114 received bolts or other threaded fasteners 116 for holding the wires/cables/bars/rods in the enclosed space 118, in a manner similar to the way in which the electrode 70 and connecting wire 72 (FIG. 8) are held in place in contact with each other.

The clamp body 112 has a pair of bottom segments 120 and 122 that are angled downward from vertical sides 130 and 132. The bottom segments 120 and 122 meet at a bottom bend 124. The bottom bend 124 may be a relatively broad bend, broader than that of the bend 24 (FIG. 1). The bend 124 and the segments 120 and 122 may form a U shape, facilitating receipt and securing of larger-diameter objects. The bend 124 may have a radius of 6.6 mm (0.26 inches), although it will be appreciated that many alternative configurations for the clamp body 112 are possible.

The insert nuts 114 hold together overlapped ends 136 and 138 of an overlapped section 134 of the clamp body 112. The end 136 has a pair of holes 140, and the end 138 has a pair of holes 142. When the ends 136 and 138 are overlapped, the holes 140 align with the holes 142. The insert nuts 114 are in the aligned sets of holes 140 and 142. The nuts 114 are riveted in place, with each of the rivets having an unthreaded upper rivet section 152 that is deformed outward and down against a top surface 154 of the end 138. This deformed section 152 holds the nuts 114 in place in the overlapped section 134. The bolts 116 are received in internally-threaded central portions 155 of nut bodies 156 of the insert nuts 114.

The nuts 114 each have a pair of flat faces 160 and 162 on opposite sides of a flange 158 of the nut body 156. The faces 160 and 162 bear against and/or engage the vertical sides 130 and 132. The faces 160 and 162 may be substantially parallel to one another, diametrically opposed on opposite sides of the nut body 156. The distance between the faces 160 and 162 may be substantially the same as the distance between the inside surfaces or faces of the vertical sides 130 and 132. For example the faces 160 and 162 may be 18.3 mm (0.72 inches) apart, while the inner surfaces of the sides 130 and 132 may be 19.0 mm (0.75 inches) apart. The use of the faces 160 and 162 of the pair of nuts 114 to support both of the vertical sides 130 and 132 provides functions similar to those of the end tab 44 (FIG. 1), opposing twisting of the clamp body 112, opposing elongation of the clamp body 112, in general facilitating the maintenance of integrity of the clamp body 112, and preventing rotation of the nuts 114 within the clamp body 112.

The clamp body 112 has a series of grooves 166 on its inner surface 168. The grooves 166 are parallel to one another at different distances along a length 176 of the clamp body 112. Thus the grooves 166 may be substantially parallel to a longitudinal direction 178 of a sheet metal strip 146 used to form the clamp body 112. The grooves 166 may be substantially perpendicular to the direction of the clamp 110 in which the wires/cables/bars/rods are inserted (the direction parallel to the length 176). The grooves 166 facilitate gripping and securing of the wires/cables/bars/rods in the enclosed space 118.

The clamp body 112 may be made of suitable sheet steel, which may be heat treated to enhance its mechanical properties. The clamp body 112 may be formed by stamping and/or by other suitable well-known processes.

The clamp 110 may be used as a coupler to couple together a pair of objects. The objects may be a pair of substantially round objects, such as a pair of reinforcing bars. The objects coupled together in the enclosed space 118 of the clamp 110 may be overlapped within the enclosed space 118. This lapping increases the holding power of the clamp 110 when it is used as a mechanical coupler. In other words, overlapping may increase the mechanical resistance to disengagement of the coupled objects from the clamp/coupler 110. Of course use of the clamp 110 as a coupler should not exceed the rated ability of the clamp 110 to perform a coupling function.

It will be appreciated that other details of the clamp 110 may be similar to those of the clamp 10 (FIG. 1). The various different features of the clamps 10 and 110 may be combined in a single device, where possible.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A clamp comprising:

a non-rigid sheet metal clamp body with an overlapped section, defining an enclosed space surrounded by the clamp body, for receiving objects to be clamped, wherein the overlapped section includes a pair of ends with respective holes therein, wherein the holes are substantially aligned when the ends are overlapped; and a threaded nut inserted in the holes;

wherein the threaded nut has a flange on a lower part, wherein the flange limits insertion of the nut into the holes;

wherein the flange has a flat face that engages the clamp body to prevent rotation of the nut relative to the clamp body;

wherein the flat face engages a bent tab bent down from one of the ends; and wherein the bent tab makes contact with one of a pair of side surfaces of the clamp body.

2. The clamp of claim 1, further comprising a threaded fastener is threaded through the nut to engage one or more objects in the enclosed space.

3. The clamp of claim 2, in combination with a pair of objects clamped together in contact with one another within the enclosed space, between the threaded fastener and the clamp body.

4. The combination of claim 3, wherein the objects have substantially circular cross sections.

5. The clamp of claim 1, wherein the threaded nut is riveted to the sheet metal body.

6. The clamp of claim 1, wherein the side surfaces are substantially parallel.

7. The clamp of claim 6, wherein the flange includes an additional flat face; and wherein the flat faces engage respective of the side surfaces to prevent rotation of the threaded nut relative to the clamp body.

8. The clamp of claim 1, wherein the overlapped section has an additional set of holes, with an additional nut in the additional set of holes.

9. The clamp of claim 1, wherein the clamp body has a bottom portion that is opposite the holes; and wherein the clamp body has a pair of substantially parallel sides between the bottom portion and the ends.

10. The clamp of claim 9, wherein the bottom portion is a V-shape bottom portion.

11. The clamp of claim 9, wherein the bottom portion is a U-shape bottom portion.

12. The clamp of claim 1, wherein the sheet metal body is stamped from a sheet metal strip.

13. The clamp of claim 12, wherein the sheet metal strip has top/bottom symmetry about a line in a longitudinal direction of the strip.

14. The clamp of claim 13, wherein the sheet metal strip has left/right symmetry about a line perpendicular to the longitudinal direction of the strip.

15. The clamp of claim 1, wherein the sheet metal body includes stainless steel.

16. The clamp of claim 1, wherein the nut and the sheet metal body are made from the same material.

* * * * *